US006646362B2

(12) United States Patent
Bert et al.

(10) Patent No.: US 6,646,362 B2
(45) Date of Patent: Nov. 11, 2003

(54) ELECTRICAL CIRCUIT FOR TRANSMITTING STATE INFORMATION, IN PARTICULAR CONCERNING RAIL ROLLING STOCK, AND AN ELECTRICAL SYSTEM INCORPORATING SUCH A CIRCUIT

(75) Inventors: Michel Bert, Charly (FR); Patrick Convert, Siccieu Saint Julien Carrisieu (FR)

(73) Assignee: Alstom, Paris (FR)

( * ) Notice: Subject to any disclaimer, the term of this patent is extended or adjusted under 35 U.S.C. 154(b) by 168 days.

(21) Appl. No.: 09/987,651

(22) Filed: Nov. 15, 2001

(65) Prior Publication Data

US 2002/0094703 A1 Jul. 18, 2002

(30) Foreign Application Priority Data

Nov. 24, 2000 (FR) ..... 00 15221

(51) Int. Cl.[7] ..... H01H 35/00
(52) U.S. Cl. ..... 307/130
(58) Field of Search ..... 307/112, 116, 307/125, 126, 130; 340/500, 514, 517, 520–525

(56) References Cited

U.S. PATENT DOCUMENTS 5,294,881 A * 3/1994 Pierret et al. ..... 322/28
5,923,095 A * 7/1999 Iwatani et al. ..... 307/10.1
6,404,163 B1 * 6/2002 Kapsokavathis et al. .... 320/104
6,483,431 B2 * 11/2002 Bert et al. ..... 340/509

FOREIGN PATENT DOCUMENTS

| | | |
|---|---|---|
| DE | 42 20 778 A | 1/1994 |
| DE | 44 13 467 C | 9/1995 |
| DE | 195 13 615 A | 10/1995 |

* cited by examiner

*Primary Examiner*—Matthew V. Nguyen
(74) *Attorney, Agent, or Firm*—Sughrue Mion, PLLC

(57) ABSTRACT

The invention relates to an electrical circuit for transmitting the state of a parameter or of an item of equipment, said electrical circuit being designed to be connected to the terminals of a power supply storage battery and comprising: an isolated link between said electrical circuit and an output (S) for transmitting an item of state information; and a switch whose open position or whose closed position is representative of the state information and which determines whether current flows through said electrical circuit, the electrical circuit transmitting the state information from the switch to the output via the isolated link. To regulate the magnitude of the current in the switch, the electrical circuit further comprises variable voltage generator means co-operating with switching means to power component elements of the electrical circuit selectively as a function of the output voltage of said variable voltage generator means, and wherein the electrical circuit further comprises inductive filter means in series with the switch, and capacitive storage means, each of which, under steady state conditions, forming energy-storage means and energy-yielding means for storing or yielding a portion of the energy of said electrical circuit, depending on the output voltage of the variable voltage generator.

14 Claims, 2 Drawing Sheets

ELECTRICAL CIRCUIT FOR TRANSMITTING STATE INFORMATION, IN PARTICULAR CONCERNING RAIL ROLLING STOCK, AND AN ELECTRICAL SYSTEM INCORPORATING SUCH A CIRCUIT

The invention relates to an electrical circuit for conveying information of the on/off type, in particular for use in the rail field.

BACKGROUND OF THE INVENTION

In a train, numerous signals of the on/off type indicating the state of a parameter or of an item of equipment are conveyed, for example to an electronic circuit for controlling automatic logic controllers or to a monitoring and signalling panel. For example, such signals are representative of the state of a circuit-breaker or of the open or the closed position of a door giving access to a carriage, and they must be conveyed with a high degree of security and availability, which makes low-energy links of the computer type unsuitable for this type of use.

A solution that is currently used consists in connecting a closed-loop electrical circuit across the terminals of a storage battery, that circuit comprising, in series, at least one switch associated with the state of the member to be monitored, a resistor, and an isolated link connected to the device to which the information contained in the signal is addressed, e.g. the electronic circuit for controlling an automatic logic controller, or the monitoring and signalling panel.

The open or the closed position of the switch is representative of the state of a parameter or of an item of equipment. When the switch is closed, current whose magnitude is limited by the resistor, flows through the circuit. When it is open, no current flows. The presence or the absence of this current is transformed by the isolated link into on/off information communicated to the electronic circuit.

Generally, a train has a plurality of such circuits connected to the terminals of the same storage battery.

Since the switches tend to oxidize, some minimum current, of about a few tens of milliamps, must pass through each of the switches to clean them. The current is consumed and lost in the resistor. In addition, the power dissipated in the resistor by the Joule effect produces heat which must be removed. One known solution consists in using fans. However, currently the use of such fans as a mode of cooling the electronic circuits on board trains is avoided or even prohibited for reasons of reliability, since a fan includes mechanical components that might jam or seize and in general might fail.

Since the reliability of electrical and electronic components decreases greatly when the ambient temperature increases, it is desirable to produce as little heat as possible.

In addition, since the storage battery generally powers several circuits, and other items of equipment, the voltage that it delivers varies over time with varying load across its terminals. The current in the circuit thus also varies, in proportion to the charge of the storage battery.

As a result, to obtain the minimum current required for cleaning the switches, it must be accepted that a large amount of extra current and therefore power must be consumed during certain periods in the operation of the circuit. The resulting additional production of heat increases the problem of removing said heat.

The quantity of heat dissipated increases with the number of switches and of items of information to be transmitted.

OBJECTS AND SUMMARY OF THE INVENTION

The invention aims to reduce the above-mentioned drawbacks of the prior art.

An object of the invention is thus to convey an item of information of the on/off type with a high degree of reliability and availability, while reducing the power dissipated by the Joule effect.

To this end, the invention provides an electrical circuit for transmitting the state of a parameter or of an item of equipment, said electrical circuit being designed to be connected to the terminals of a power supply storage battery and comprising:

- an isolated link between said electrical circuit and an output for transmitting an item of state information; and
- a switch whose open position or whose closed position is representative of the state information and which determines whether current flows through said electrical circuit, the electrical circuit transmitting the state information from the switch to the output via the isolated link;
- wherein, to regulate the magnitude of the current in the switch, said electrical circuit further comprises variable voltage generator means co-operating with switching means to power component elements of the electrical circuit selectively as a function of the output voltage of said variable voltage generator means, and wherein said electrical circuit further comprises inductive filter means in series with the switch, and capacitive storage means, each of which, under steady state conditions, forming energy-storage means and energy-yielding means for storing or yielding a portion of the energy of said electrical circuit, depending on the output voltage of the variable voltage generator.

According to other characteristics of the electrical circuit:

- the inductive filter means are disposed in the immediate vicinity of the switch;
- a diode is interposed between said switch and said inductive filter means, said diode being biased so as to prevent the current of the switch from flowing from the inductive filter means to the switch;
- the inductive filter means are constituted by an inductor, the electrical circuit having, in series with the switch and the inductor, first and second branches in parallel, and having a resistor, in parallel with the switch and the inductor and connected to a point of the second branch, a capacitor being connected in the first branch, and the connection-switching means comprise a diode connected in the second branch between firstly one of the junctions of the first and second branches and secondly the point at which the resistance is connected to the second branch, the second branch further comprising a capacitor connected between firstly the other of the junctions of the first and second branches and secondly the point at which the resistor is connected to the second branch;
- the isolated link is connected in series with the inductive filter means;
- the isolated link is connected in series with the resistor;
- the signal produced by the voltage generator means is a rectangular, triangular, or sinusoidal signal optionally centered on 0 volts;

the variable voltage generator means are connected in the first branch;

the isolated link consists of an optocoupler;

the isolated link consists of a transformer;

the isolated link consists of a transformer connected in series with the switch and whose primary also forms at least a portion of the inductive storage means; and the switch is connected to a terminal of the storage battery, and a peak clipper is disposed between the output of said switch and the other terminal of the storage battery.

The invention also provides an electrical system designed to transmit a plurality of items of state information, said electrical system comprising a storage battery and a plurality of electrical circuits as defined above, each of which serves to transmit an item of state information, the circuits being connected in parallel to the terminals of the said storage battery.

According to another characteristic of the electrical system, it is on board a rail train, each switch being associated with a member or an item of equipment of said rail train, for monitoring the state or the position of said member or of said item of equipment.

BRIEF DESCRIPTION OF THE DRAWINGS

The invention will be better understood on reading the following description given by way of example and with reference to the accompanying drawings, in which.

MORE DETAILED DESCRIPTION

To make the drawings more legible, only those elements that are necessary to understand the invention are shown. Like elements bear like references from one figure to another.

Figure 1:
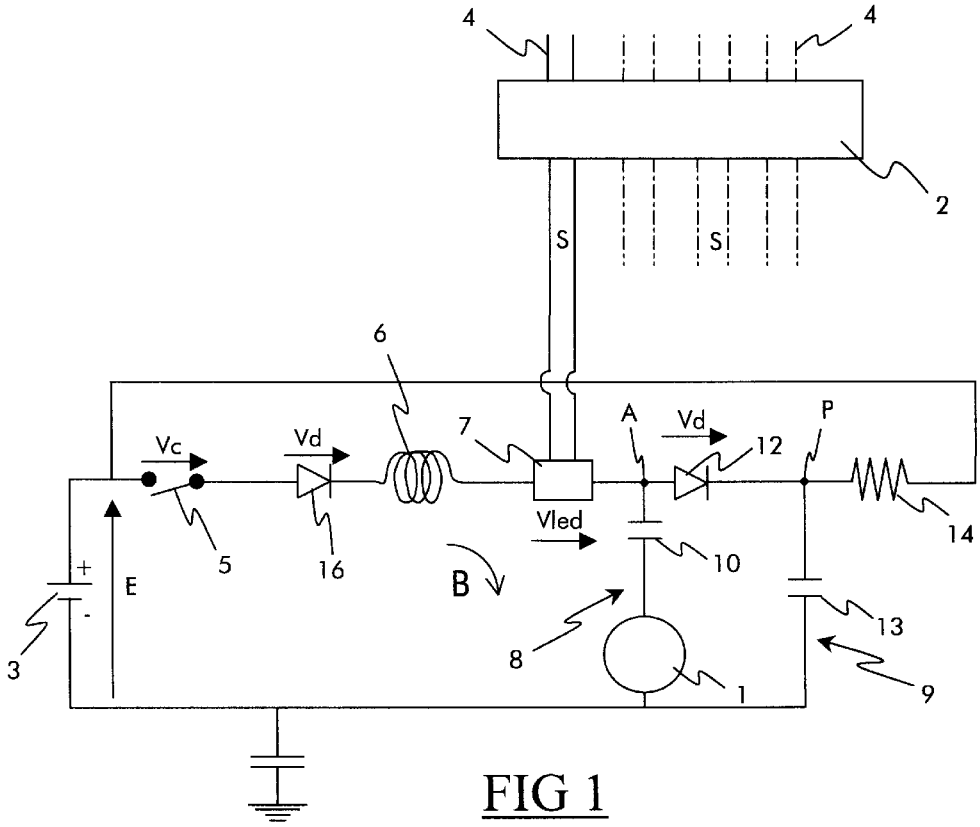
FIG. 1 shows an electrical circuit for transmitting a plurality of items of on/off information in a particular embodiment of the invention.

FIG. 1 shows a particular embodiment of a transmission circuit suitable for transmitting an item of on/off information representative of the state of a member or of an item of equipment to be monitored, in particular rail vehicle equipment. FIG. 1 shows, on its own, an elementary circuit that is part of a fuller electrical system (not shown) comprising a plurality of similar elementary circuits connected in parallel across the terminals of a storage battery and suitable for transmitting a plurality of items of on/off information to an electronic circuit for controlling automatic logic controllers.

The electrical transmission circuit is connected across the terminals of a storage battery 3, and a connection S at the output of the elementary circuit retrieves the on/off information by means of a link which is described below, so as to transmit it to one of the input ports of an electronic circuit 2.

The electronic circuit 2 also has output ports 4, e.g. for controlling automatic logic controllers (not shown).

In the main application in question, the storage battery 3, the electrical system, and the electronic circuit 2 are designed to be on board a train. Naturally, the electronic circuit 2 for controlling automatic logic controllers may be replaced with a monitoring and signalling panel or with any device suitable for receiving and processing on/off information.

Generally, the storage battery 3 is the only source of DC voltage for the whole train. Thus, the various items of on-board equipment that require DC powering are powered by the single storage battery 3. The voltage that it delivers can therefore vary over time, as a function of the load across its terminals, in the range 0.6 times its nominal voltage to 1.4 times its nominal voltage.

At present, the storage batteries 3 generally in use in trains have nominal voltages of 24 volts, 36 volts, 48 volts, 96 volts, and 110 volts.

As shown in FIG. 1, the electrical transmission circuit comprises a loop B powered by the storage battery 3 and comprising, disposed in series, a switch 5, a diode 16, an inductor 6, an isolated link 7 which may, for example, be implemented by means of an optocoupler, and two branches 8 and 9 in parallel originating at a point A disposed at the output of the isolated link 7. The diode 16 is biased so as to prevent the inductor 6 from discharging elsewhere than through the optocoupler 7.

For reasons of convenience, the following convention is adopted in the remainder of the description, the direction of flow of current in the loop B from the positive terminal to the negative terminal of the storage battery 3 defines a positive direction for the loop B.

Figure 2:
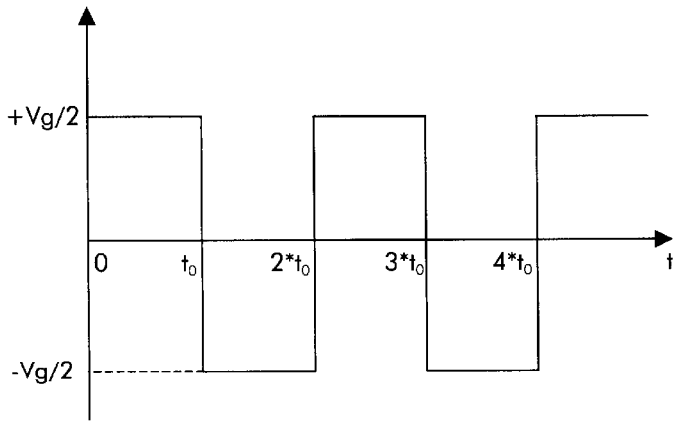
FIG. 2 is a graph showing the output voltage of the voltage generator.

The branch 8 comprises, disposed in series, a capacitor 10 and a variable voltage generator 1 producing a squarewave signal of half period to and of symmetrical peak-to-peak amplitude $V_g$ as shown in FIG. 2. The value of the voltage amplitude $V_g$ is chosen to be lower than the voltage E across the terminals of the storage battery 3 and is, for example, about 15 V.

The second branch 9 comprises a diode 12 and a capacitor 13 in series. A resistor 14 is disposed between the positive terminal of the storage battery 3 and a point P of the second branch 9 that is located between the diode 12 and the capacitor 13. The diode 12 is biased so as to prevent the capacitor 13 from discharging elsewhere than via the resistor 14.

Operation of the electrical circuit is described below. In the following description, the following variables are used by convention:

$V_d$ is the voltage drop in each of the diodes 10, 16, where $V_d$ is about 0.5 V;

$V_{led}$ is the voltage drop in the LED of the optocoupler 7, where $V_{led}$ is about 2 V;

$V_c$ is the voltage drop in the input contact 5, where $V_c$<E; and $V_A$ is the voltage at point A and $V_P$ is the voltage at point P.

The capacitances of the capacitors 10 and 13 are chosen so that $C_{13}$>>$C_{10}$, and the resistance of the resistor 14 is chosen to be low.

The member or the item of equipment whose state is to be monitored actuates the opening and the closing of the switch 5.

When the switch 5 is open, the voltage upstream from the diode 16 is zero and the current $i_{led}$ through the LED of the optocoupler 7 is zero, the optocoupler then not delivering any output current to the connection S.

When the switch 5 is moved from its open position to its closed position, two distinct stages start as a function of the output voltage of the voltage generator 1. It is assumed that the electrical circuit is under steady state conditions.

In a first stage, the voltage of the generator 1 goes from $-\frac{1}{2}V_g$ to $+\frac{1}{2}V_g$ at time t=0. The inductor 6 of inductance L is then subjected to the voltage delivered by the storage battery 3 through the diode 16, and the diode 12 goes immediately to the conducting state, the voltage $V_A$ at the point A becoming equal to the voltage $V_P$ at the point P, i.e. by considering the voltage in the second branch 9 and by ignoring the voltage across the terminals of the resistor 14: $V_A=V_P\approx E+V_d$.

Since the diode 12 conducts, the variation in the charge of the capacitor 10 of the first branch 8 is transferred instantly via the diode 12 to the capacitor 13 of the second branch 9 in compliance with the following relationship:

$$\Delta Q_{C10}=C_{10}*\Delta U=C_{10}*(V_A(-t_0<t<0)-(-\tfrac{1}{2}V_g)-(V_A(0<t<t_0)-\tfrac{1}{2}V_g))$$

where $V_A(-t_0<t<0)=E-V_c-V_d-V_{led}$ and $V_A(0<t<t_0)=E+V_d$. Hence $\Delta Q_{C10}=C_{10}*(V_g-V_c-2*V_d-V_{led})$ The variation in charge of the inductor 6 of the first branch is also transferred immediately via the diode 12 to the capacitor 13 subject to a slight increase in the voltage across its terminals (because $C_{13}>>C_{10}$) and the charge is then dissipated in the resistor 14.

During this first stage, the current variation in the inductor 6 can be calculated from the relationship $U_L=L*di/dt$ with the voltage across the terminals of the inductor 6 being equal to $U_L=E-V_C-V_d-(E+V_d+V_{led})$ Hence $U_L=-(2*V_d+V_{led}+V_C)$.

The current in the inductor thus varies linearly during the first stage, in compliance with the following relationship:

$$\Delta i_{led}(t)=\int_0^t -\frac{V_c+2*V_d+V_{led}}{L}*d\tau$$

the inductor 6 then acting as a current generator. Since its inductance L is high, we have $$\Delta i_{led}(t_0)=-\frac{V_c+2*V_d+V_{led}}{L}*t_0$$

which is very low. The variation in current through the LED of the optocoupler 7 during the first stage is thus very low.

In a second stage, the voltage across the generator goes from $+\frac{1}{2}V_g$ to $-\frac{1}{2}V_g$ for $t=t_0$ and the diode 12 goes to the non-conducting state. The voltage at the point A then goes immediately to $V_A=E+V_d-V_g$ and varies to reach the value $V_A=E-V_C-V_d-V_{led}$ for $t=2*t_0$ corresponding to the start of the first stage again. During this stage, the current passing through the inductor 6 is blocked by the diode 12 and is thus transferred fully to the capacitor 10 which receives the charge:

$$\Delta Q_{C10}=C_{10}*(V_g-V_c-2*V_d-V_{led})$$

The capacitor 10 thus retrieves the charge that it lost during the first stage.

At the terminals of the capacitor 10, $$\Delta U(t)=\frac{i_{led}*t}{C_{10}}$$

where $i_{led}$ is substantially constant because the inductance L of the inductor 6 is high. It is thus deduced therefrom that the voltage varies substantially linearly over time.

The voltage at the point A thus varies in compliance with the following relationship:

$$V_A(t)=\frac{V_{t=2t0}-V_{t=t0}}{t_0}*t+V_{t=t0}$$

the following is obtained:

$$V_A(t)=\frac{(V_g-V_c-V_d-V_{led})-(E+V_d-V_g)}{t_0}*t+E+V_d-V_g$$

i.e.

$$V_A(t)=\frac{V_g-V_c-2*V_d-V_{led}}{t_0}*t+E+V_d-V_g$$

The voltage across the terminals of the inductor 6 is determined by the following relationship:

$$U_L(t)=(E-V_c-V_d-V_{led})-V_A(t)$$

hence $$U_L(t)=(E-V_c-V_d-V_{led})-\frac{(V_g-V_c-V_d-V_{led})-(E+V_d-V_g)}{t_0}*t+E+V_d-V_g$$

i.e.

$$U_L(t)=-\frac{(V_g-V_c-2*V_d-V_{led})}{t_0}*t+(V_g-V_c-2*V_d-V_{led})\text{ and}$$

$$\Delta i_L(t)=\frac{1}{L}\int_0^t\left(-\frac{(V_g+V_c-2*V_d-V_{led})}{t_0}*\tau+(V_g-V_c-2*V_d-V_{led})\right)*d\tau$$

i.e.

$$\Delta i_L(t)=\frac{(V_g+V_c-2*V_d-V_{led})}{L}*\left(t-\frac{t^2}{2*t_0}\right)$$

Figure 3:
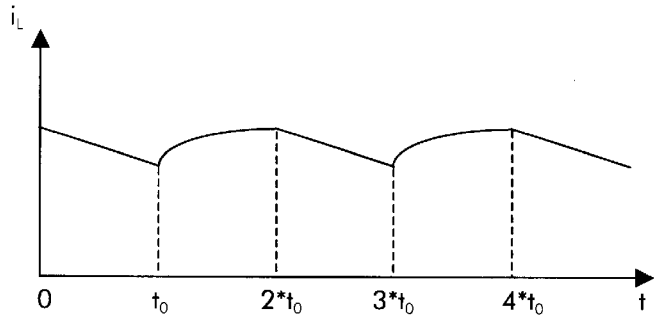
FIG. 3 is a graph showing the ideal value of the current as a function of time in the branch of the circuit that includes the switch, the scale up the y-axis being magnified so as to show the current variation in exaggerated manner.

The variation in the current $i_L$ in the inductor 6 during the first and second stages is shown in exaggerated manner so as to be more visible on the graph of FIG. 3.

In FIG. 3, without being entirely constant, the current $i_L$ in the inductor 6 varies over a small range only. Its mean value may be adjusted in order to pass the minimum current required to clean the switch 5, by regulating the duty ratio, which in this example is equal to:

$$\alpha=\frac{t_0}{2*t_0}=\frac{1}{2}$$

and the amplitude of the voltage $V_g$ produced by the generator 1.

Since the current that passes through the inductor 6 also flows through the optocoupler 7, then, when the switch 5 is closed, current is thus established in the optocoupler 7 which responds by producing an outlet signal at the connection S. The position of the optocoupler 7 in series with the switch 5 is advantageous since the signal that it generates at the output is a substantially faithful image of the current that passes through the inductor 5.

Operation of the invention, as described above, reduces the energy dissipated by the Joule effect in two ways.

Firstly, the voltage generator 1 sustains the level of energy in the circuit, and only the power that it releases for this purpose is consumed by the Joule effect.

Secondly, the magnitude of the current $i_L$ injected into the circuit is independent of the voltage E delivered by the storage battery 3. Thus, a variation of the voltage E delivered by the storage 3 does not cause any variation in the current consumed by the resistor 14.

Figure 4:
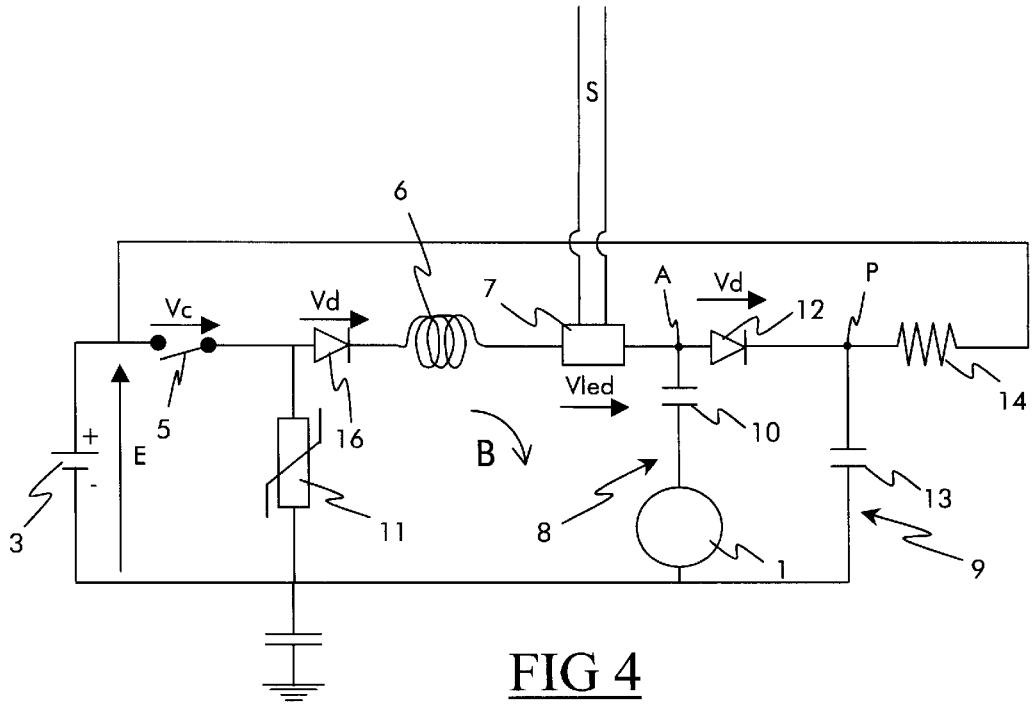
FIG. 4 shows a variant embodiment of the electrical circuit of FIG. 1.

FIG. 4 shows a variant embodiment of the electrical circuit of FIG. 1, in which a peak clipper 11 is disposed between the negative terminal of the storage battery 3 and a point situated between the switch 5 and the diode 16. Operation of the electrical circuit remains the same, with the peak clipper 11 providing increased ability to withstand voltage surges.

In another variant (not shown), the isolated link 7 consists of magnetic coupling implemented by a transformer whose primary winding also forms, at least in part, the winding of the inductor 6, the secondary winding being connected to the connection S. Operation of the electrical circuit remains unchanged. The variation of the current $i_L$ in the inductor 6, when the switch 5 is closed, produces as output a voltage and/or a current at the terminals of the secondary of the transformer 7 to constitute the output signal, after rectification by a rectifier (not shown).

In another variant (not shown), the isolated link 7 may be placed in series with the load resistor 14, operation of the elementary circuit remaining the same.

The invention is not limited to the variant embodiments described above. In particular, the current generator may deliver other variable waveforms such as triangular or sinusoidal waveforms optionally centered on 0 volts. In the above-described embodiment, a variable voltage generator that produces a squarewave signal is chosen in order to simplify the equations and to facilitate explaining operation of the electrical circuit. However, in practice, a voltage generator that produces a triangular signal is advantageously chosen.

The invention is not limited to a rail application, but rather it relates to transmitting on/off information in any field.

Among the advantageous of the invention, it should be noted that the presence of the inductor upstream from the optocoupler makes it possible to smooth the current passing through the optocoupler so that it presents low ripple, which is favorable to the optocoupler having a good life span.

In addition, the inductor at the input of the electrical circuit also makes it possible to limit generation of electromagnetic noise that can be transmitted to other items of equipment.

The presence of capacitors between the positive terminal and the negative terminal of the storage battery also makes it possible to guarantee that, in the event of failure of one of the active components of the electrical circuit, there is no short-circuit at the terminals of the storage battery under any circumstances.

What is claimed is:

1. An electrical circuit for transmitting the state of a parameter or of an item of equipment, said electrical circuit being designed to be connected to the terminals of a power supply storage battery and comprising:

an isolated link between said electrical circuit and an output (S) for transmitting an item of state information; and a switch whose open position or whose closed position is representative of the state information and which determines whether current flows through said electrical circuit, the electrical circuit transmitting the state information from the switch to the output via the isolated link;

wherein, to regulate the magnitude of the current in the switch, said electrical circuit further comprises variable voltage generator means co-operating with switching means to power component elements of the electrical circuit selectively as a function of the output voltage of said variable voltage generator means, and wherein said electrical circuit further comprises inductive filter means in series with the switch, and capacitive storage means, each of which, under steady state conditions, forming energy-storage means and energy-yielding means for storing or yielding a portion of the energy of said electrical circuit, depending on the output voltage of the variable voltage generator.

2. An electrical circuit according to claim 1, wherein the inductive filter means are disposed in the immediate vicinity of the switch.

3. An electrical circuit according to claim 2, wherein a diode is interposed between said switch and said inductive filter means, said diode being biased so as to prevent the current of the switch from flowing from the inductive filter means to the switch.

4. An electrical circuit according to claim 1, wherein the inductive filter means are constituted by a n inductor, the electrical circuit having, in series with the switch and the inductor, first and second branches in parallel, and having a resistor, in parallel with the switch and the inductor and connected to a point of the second branch, a capacitor being connected in the first branch, and wherein the connection-switching means comprise a diode connected in the second branch between firstly one of the junctions of the first and second branches and secondly the point at which the resistance is connected to the second branch, the second branch further comprising a capacitor connected between firstly the other of the junctions of the first and second branches and secondly the point at which the resistor is connected to the second branch.

5. An electrical circuit according to claim 4, wherein the isolated link is connected in series with the inductive filter means.

6. An electrical circuit according to claim 4, wherein the isolated link is connected in series with the resistor.

7. An electrical circuit according to claim 1, wherein the signal produced by the voltage generator means is a rectangular, triangular, or sinusoidal signal optionally centered on 0 volts.

8. An electrical circuit according to claim 1, wherein the variable voltage generator means are connected in the first branch.

9. An electrical circuit according to claim 1, wherein the isolated link consists of an optocoupler.

10. An electrical circuit according to claim 1, wherein the isolated link consists of a transformer.

11. An electrical circuit according to claim 10, wherein the isolated link consists of a transformer connected in series with the switch and whose primary also forms at least a portion of the inductive storage means.

12. An electrical circuit according to claim 1, wherein, with the switch being connected to a terminal of the storage battery, a peak clipper is disposed between the output of said switch and the other terminal of the storage battery.

13. An electrical system designed to transmit a plurality of items of state information, said electrical system comprising a storage battery and a plurality of electrical circuits according to claim 1, each of which serves to transmit an item of state information, the circuits being connected in parallel to the terminals of the said storage battery.

14. An electrical system according to claim 13, the electrical system being on board a rail train, each switch being associated with a member or an item of equipment of said rail train, for monitoring the state or the position of said member or of said item of equipment.

* * * * *